US005129757A

United States Patent [19]

Johnson

[11] Patent Number: 5,129,757

[45] Date of Patent: Jul. 14, 1992

[54] WATER REMOVAL SYSTEM

[76] Inventor: Kenneth O. Johnson, 906 N. Triplette Dr., Castleberry, Fla. 32707

[21] Appl. No.: 685,041

[22] Filed: Apr. 15, 1991

[51] Int. Cl.[5] ..... E02B 11/00

[52] U.S. Cl. ..... 405/43; 405/36; 405/45

[58] Field of Search ..... 405/45, 43, 39, 50, 405/74, 73, 46, 47, 36; 37/78, 75, 54

[56] References Cited

U.S. PATENT DOCUMENTS

| | | | |
|---|---|---|---|
| 218,875 | 8/1879 | Green | 405/43 |
| 3,368,355 | 2/1968 | Shroyer | 405/39 |
| 3,965,685 | 6/1976 | D'Amiano | 405/43 |
| 4,288,174 | 9/1981 | Laws | 405/43 |
| 4,927,292 | 5/1990 | Justice | 405/43 |

*Primary Examiner*—Dennis L. Taylor
*Attorney, Agent, or Firm*—Frank A. Lukasik

[57] ABSTRACT

The invention is a water remover-soil stabilizer, comprised of PVC pipes assembled in a polygonal shape with a discharge pipe at an upper end and connected to a water withdrawal pump. Water is admitted to the lower, horizontal pipe, through a plurality of extremely narrow slits, longitudinally spaced, and laterally extending circumferentially therein which render the section water pervious. After the pit is dug, the invention is inserted into the pit and the pumping is started. The invention withdraws only the water since the width of the slits is less than the diameter of the average sized sugar-sand grain.

4 Claims, 1 Drawing Sheet

WATER REMOVAL SYSTEM

FIELD OF THE INVENTION

This invention relates generally to water removal system for removing water from excavations and more specifically to water removal from an excavated pit in fluid soil.

BACKGROUND OF THE INVENTION

It is known that at a construction site or along a proposed path of underground utility lines, it is necessary to lower the water table level. One method for lowering the water table is the use of horizontal well pipe. The well pipe is placed at the bottom of a trench and then back filled with the excavated earth or with substitute fill conveyed to the trench. A suction pump is attached at an above-ground end of the pipe to continuously draw up water that enters perforations in a horizontal portion of the well pipe until the water table is lowered. One such device is disclosed in U.S. Pat. No. 4,927,292 to Justice.

U.S. Pat. No. 3,753,352 to McNally discloses a perforate conduit comprising an elongated tubing with at least one series of longitudinally extending, spaced apart ridges formed in the wall of and extending outwardly from the surface of the tubing. At least one opening is provided in each of the ridges to provide a drainage opening into the tube. The ridges are formed during extrusion, and the tops are cut off to form the opening. The invention is used for land drainage, in various lengths of up to 4 feet, laid end-to-end in excavations.

U.S. Pat. No. 4,626,129 to Kothmann et al discloses a sub-soil drainage pipe segment which has connecting formations at opposite ends. A number of such segments can be interconnected end-to-end to form a sub-soil drainage line, the segment also having a plurality of circumferentially spaced, longitudinally extending slots which render the segment water pervious.

Non of the prior art devices are concerned with withdrawing sub-soil with the water as it is pumped to the surface. The sub-soil drainage pipes use gravel to block the withdrawal of sub-soil. Furthermore, the very nature of the devices, i.e., continuous flow without any consideration of withdrawal of soil would not be practical for the principle object of the invention, which is to prevent enlargement of a cable splice pit which has been dug in fluid soil.

SUMMARY OF THE INVENTION

The invention is a water remover-soil stabilizer, comprised of PVC pipes assembled in a polygonal shape with a discharge pipe at an upper end and connected to a water withdrawal pump. Water is admitted to the lower, horizontal pipe, through a plurality of extremely narrow slits, longitudinally spaced, and laterally extending circumferentially therein which render the section water pervious. The invention is particularly useful in a pit such as a telephone splice pit which normally is 4'×4'×3' deep. After the pit is dug, the invention is inserted into the pit and the pumping is started. Unlike other prior art devices, the invention withdraws only the water since the width "w" is less than the diameter of the average sized sugar-sand grain. Also unlike prior art devices, the pit remains the same size as it was excavated and does not require additional fill when the splicing is completed and the pit is filled.

The invention would also be useful in other excavations such as at construction sites which generally must construct retaining walls to prevent cave-ins caused by removal of soil along with the unwanted water which is pumped out. By retaining the size of the excavation at its original size, and the reduction of additional fill material, the invention also reduces the amount of compacting and settling damage which generally occur at construction sites.

It is therefore an object of the invention to provide a low cost, effective water removal system.

It is a further object of the invention to provide a water removal system to extract water and stabilize the sand to prevent cave-ins.

A still further object of the invention is to provide a water removal system wherein water is extracted through a water pervious, horizontal pipe having a plurality of extremely narrow slits formed therein.

The above objects and advantages will become more apparent when reference is made to the following description taken in conjunction with the accompanying drawings.

DETAILED DESCRIPTION OF THE PREFERRED EMBODIMENTS

Figure 1:
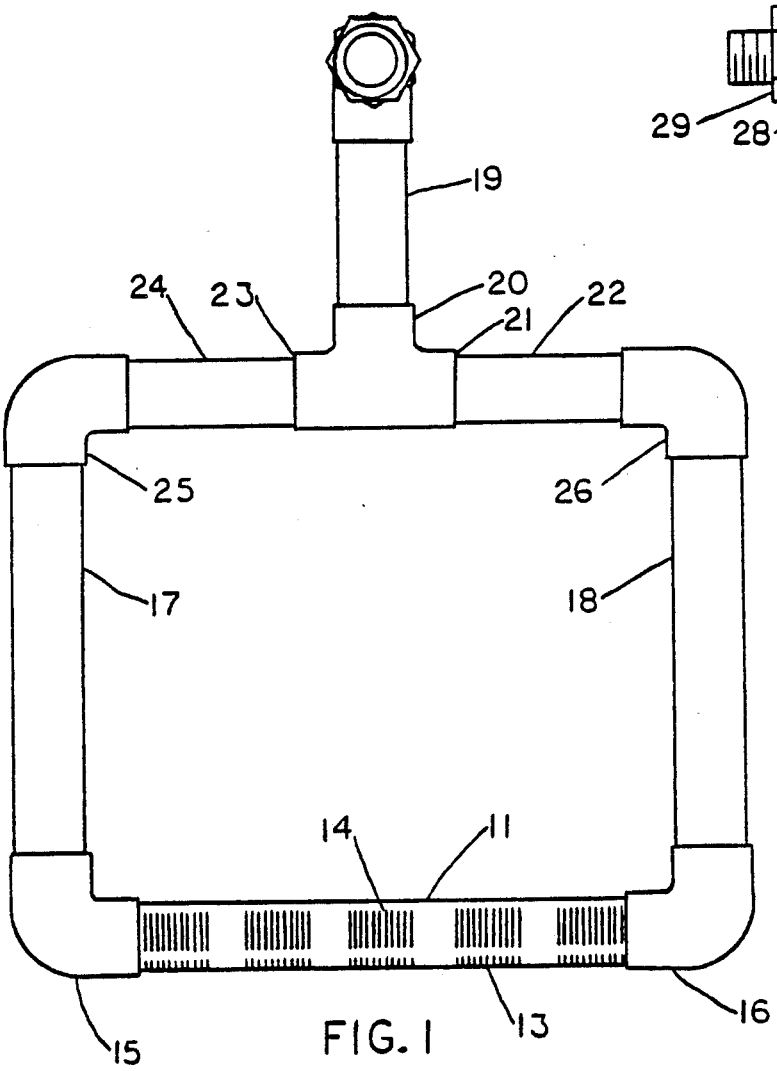
FIG. 1 is a front view of the water removal system of the invention.
Figure 2:
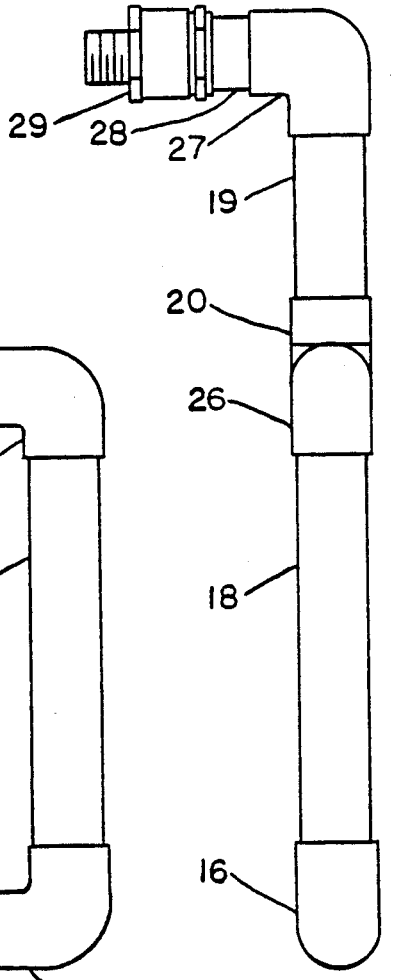
FIG. 2 is a side view of the water removal system of the invention.

In describing a preferred embodiment of the invention illustrated in the drawings, specific terminology will be used for the sake of clarity. However, the invention is not intended to be limited to the specific terms selected, and it is to be understood that each specific term includes all technical equivalents which operate in a similar manner to accomplish a similar purpose.

Referring first to FIG. 1, reference numeral 10 generally indicates the water removal system of the invention which is made up of a number of pipe segments and connecting joints. The three types of rigid plastic pipe produced for use in home and industrial plumbing are designated PVC (polyvinyl chloride), ABS (acrylomitrile butadiene-styrene), and CPVC (chlorinated polyvinyl chloride. All three types of piping can be used for cold-water supply as well as for drainage systems. In a preferred embodiment, 1¼" PVC was used to assemble the water removal system of the invention.

Figure 3:
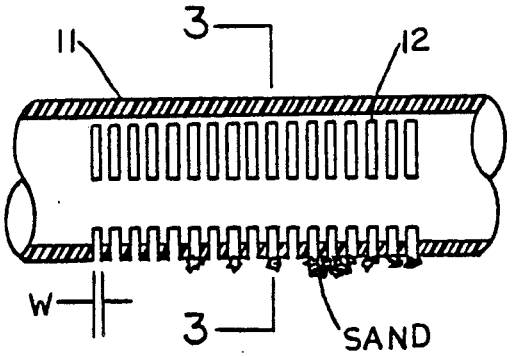
FIG. 3 is an expanded front view, partially in section, of the water pervious pipe of the invention.
Figure 4:
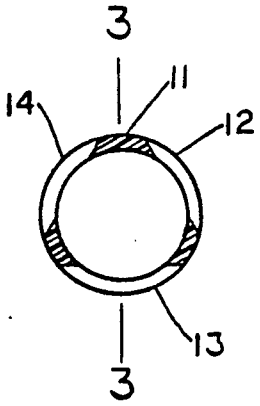
FIG. 4 is an enlarged sectional view taken along line A—A of FIG. 3.

The system will be described beginning with water pervious pipe section 11 which may be made from a section of PVC pipe which is approximately 18" long. A plurality of rows of narrow slits 12, 13 and 14, with width "w" approximately 0.009 gauge, are longitudinally spaced approximately ⅛" apart from each other, each slit forming an arc of approximately 1¼" on the outer circumference of pipe section 11. Slits 12–14 are formed along the entire length of pipe section 11 in three rows of 4¼" sections spaced approximately 1 5/16" between sections. FIGS. 3 and 4 show the arrangement of rows of slits 12, 13, and 14. Slits 12–14 may preferably be formed by cutting with an appropriate size band saw or other saw capable of cutting accurately. Improper or oversized slits will result in excessive soil removal and reduce the effectiveness of the invention.

The water removal system 10 is assembled beginning with joining 90° elbows 15 and 16 on each end of pipe 11 as by cementing the connection. All types of plastic pipe can be joined to plastic fittings such as elbows 15 and 16 by means of a special solvent cement (solvent-welded). Risers 17 and 18 are then solvent-welded to the elbows 15 and 16 already fastened to pipe 11.

Discharge pipe 19, cut to a selected length for the desired application, is solvent-welded to the vertical end of T-coupling 20. Opening 21 of T-coupling 20 is solvent-welded to imperforate pipe 22 and opening 23 is solvent-welded to imperforate pipe 24. Elbow 25 is solvent-welded to the open end of imperforate pipe 24 and elbow 26 is solvent-welded to the open end of imperforate pipe 22. With the upper (discharge) assembly completed, elbows 19 and 20 are solvent-welded to risers 17 and 18 at the ends opposite elbows 15 and 16. Elbow 27 is solvent welded to discharge pipe 19 at the end opposite T-coupling 20 with the open end facing in an axial direction perpendicular to T-coupling 20. A short piece of pipe 28 is solvent-welded to elbow 27 and a transition coupling 29 is affixed to pipe 28 at its open end.

When the water removal system is assembled it is then placed vertically in the pit or excavation to be pumped. The size and type of transition coupling 29 is selected to match the coupling of the conduit or hose attached to the water pump (sump pump or centrifugal pump) to be used.

While certain embodiments of the invention have been described for illustrative purposes, the invention is not limited thereto. Various other modifications or embodiments of the invention will be apparent to those skilled in the art in view of this disclosure. Such modifications or embodiments are within the spirit and scope of the disclosure.

What is claimed is:

1. A polygonal shaped assembly of fluid conducting conduits for removing water and stabilizing the soil in a ground excavation comprising:

water pervious means spread out horizontally on the bottom of said excavation, said water pervious means having;

a first and second end, a plurality of rows of groups of narrow slits, longitudinally spaced, and laterally extending circumferentially therein, said slits providing communication between the exterior and the interior of said means, two vertical riser means having top and bottom ends, said bottom ends affixed to said water pervious means at each of said first and second ends, and water imperforate means extending horizontally to said excavation and affixed at the top ends of said vertical riser means thereby forming a polygonal shape, and having a vertical discharge conduit with means for attaching a water withdrawal pump.

2. A polygonal shaped assembly of fluid conducting conduits according to claim 1, wherein said water pervious means consists of 1¼" PVC pipe and said slits are formed with a 0.009 gage saw.

3. A polygonal shaped assembly of fluid conducting conduits according to claim 2, wherein said slits are spaced approximately ⅛" apart from each other along the entire length of said water pervious means in three rows of 4¼" sections spaced approximately 1 5/16" between sections.

4. A polygonal shaped assembly of fluid conducting conduits for removing water and stabilizing the soil in a ground excavation comprising:

water pervious means extending horizontally to said excavation, said water pervious means consisting of 1¼" PVC and having;

a first and a second end each having a 90° elbow solvent-welded thereto, and a plurality of rows of 0.009 gage slits, longitudinally spaced, and laterally extending circumferentially therein, said slits providing communication between the exterior and the interior of said water pervious means, two vertical risers each having a top and a bottom end, said bottom ends being solvent-welded to said 90° elbows at each end of said water pervious means, a 90° elbow solvent-welded at each of said top ends of said risers, water imperforate means extending horizontally to said excavation, and solvent-welded to each of said 90° elbows located at said top of said risers, thereby forming a polygonal shape, and having a vertical discharge conduit with a transition coupling means for attaching a water withdrawal pump.

* * * * *